US007717190B2

(12) United States Patent
Keskiniva et al.

(10) Patent No.: US 7,717,190 B2
(45) Date of Patent: May 18, 2010

(54) METHOD FOR CONTROLLING PERCUSSION DEVICE, SOFTWARE PRODUCTION, AND PERCUSSION DEVICE

(75) Inventors: Markku Keskiniva, Tampere (FI); Jorma Mäki, Mutala (FI); Aimo Helin, Tampere (FI); Mauri Esko, Ikaalinen (FI); Erkki Ahola, Kangasala (FI)

(73) Assignee: Sandvik Mining and Construction Oy, Tampere (FI)

( * ) Notice: Subject to any disclaimer, the term of this patent is extended or adjusted under 35 U.S.C. 154(b) by 309 days.

(21) Appl. No.: 11/631,150

(22) PCT Filed: Jun. 30, 2005

(86) PCT No.: PCT/FI2005/050257

§ 371 (c)(1),
(2), (4) Date: Apr. 12, 2007

(87) PCT Pub. No.: WO2006/003259

PCT Pub. Date: Jan. 12, 2006

(65) Prior Publication Data

US 2009/0188686 A1 Jul. 30, 2009

(30) Foreign Application Priority Data

Jul. 2, 2004 (FI) ..... 20040929

(51) Int. Cl.
*B25D 9/26* (2006.01)
*E21B 1/00* (2006.01)

(52) U.S. Cl. ..... 173/1; 173/176; 173/91; 173/104; 173/112

(58) Field of Classification Search ..... 173/1, 173/176, 91, 104, 112
See application file for complete search history.

(56) References Cited

U.S. PATENT DOCUMENTS

| | | | | | |
|---|---|---|---|---|---|
| 3,561,542 | A * | 2/1971 | Hanson et al. | ..... | 173/1 |
| 4,165,789 | A * | 8/1979 | Rogers | ..... | 175/27 |
| 4,449,592 | A * | 5/1984 | Mayer | ..... | 175/52 |
| 4,619,334 | A | 10/1986 | Gustafsson | | |
| 4,671,366 | A | 6/1987 | Uitto et al. | | |
| 5,129,466 | A * | 7/1992 | Bartels et al. | ..... | 173/13 |
| 5,458,207 | A * | 10/1995 | Mattero | ..... | 175/27 |
| 5,699,261 | A * | 12/1997 | Muona | ..... | 700/160 |
| 6,021,855 | A | 2/2000 | Beccu et al. | | |
| 6,253,860 | B1 * | 7/2001 | Poysti et al. | ..... | 173/1 |
| 6,293,359 | B1 * | 9/2001 | Dobran et al. | ..... | 175/195 |

(Continued)

FOREIGN PATENT DOCUMENTS

EP 0 080 446 A2 6/1983

(Continued)

*Primary Examiner*—Brian D Nash
(74) *Attorney, Agent, or Firm*—Drinker Biddle & Reath LLP

(57) ABSTRACT

A method and software product for controlling a percussion device belonging to a rock-drilling machine, and a percussion device. The impact frequency of the percussion device is set so that the percussion device forms a new compression stress wave to the tool always when reflected waves from the previous compression stress waves reach a first end of the tool. This requires that the impact frequency be set proportional to the propagation time of the stress wave, whereby the length of the used tool and the propagation velocity of the stress wave in the tool material are to be noted.

12 Claims, 4 Drawing Sheets

U.S. PATENT DOCUMENTS

| | | | | |
|---|---|---|---|---|
| 7,198,117 | B2 * | 4/2007 | Uitto | 175/27 |
| 2001/0050186 | A1 * | 12/2001 | Wilson et al. | 175/38 |
| 2004/0140112 | A1 * | 7/2004 | Salminen et al. | 173/1 |
| 2004/0251049 | A1 * | 12/2004 | Keskiniva | 175/50 |
| 2008/0087467 | A1 * | 4/2008 | Kemppainen | 175/26 |

FOREIGN PATENT DOCUMENTS

| | | | |
|---|---|---|---|
| EP | 1 070 569 | A1 | 1/2001 |
| FI | 69 680 | B | 11/1985 |
| FI | 20012002 | | 2/2005 |
| GB | 835368 | | 5/1960 |
| RU | 2 221 688 | C2 | 1/2004 |
| SU | 765681 | | 9/1980 |
| WO | 03/033873 | A1 | 4/2003 |

* cited by examiner

| Tool length [feet] | Impact frequency settings with various multiples according to tool length [Hz] | | | | | | | | | | | |
|---|---|---|---|---|---|---|---|---|---|---|---|---|
| | 1/4 | 1/3 | 1/2 | 2/3 | 3/4 | 1 | 5/4 | 4/3 | 3/2 | 5/3 | 7/4 | 2 |
| 4 | 532 | 709 | 1064 | 1419 | 1596 | 2128 | 2661 | 2838 | 3193 | 3547 | 3725 | 4257 |
| 5 | 426 | 568 | 851 | 1135 | 1277 | 1703 | 2128 | 2270 | 2554 | 2838 | 2980 | 3406 |
| 6 | 355 | 473 | 709 | 946 | 1064 | 1419 | 1774 | 1892 | 2128 | 2365 | 2483 | 2838 |
| 7 | 304 | 405 | 608 | 811 | 912 | 1216 | 1520 | 1622 | 1824 | 2027 | 2128 | 2433 |
| 8 | 266 | 355 | 532 | 709 | 798 | 1064 | 1330 | 1419 | 1596 | 1774 | 1862 | 2128 |
| 9 | 236 | 315 | 473 | 631 | 709 | 946 | 1182 | 1261 | 1419 | 1577 | 1655 | 1892 |
| 10 | 213 | 284 | 426 | 568 | 639 | 851 | 1064 | 1135 | 1277 | 1419 | 1490 | 1703 |
| 11 | 193 | 258 | 387 | 516 | 580 | 774 | 967 | 1032 | 1161 | 1290 | 1354 | 1548 |
| 12 | 177 | 236 | 355 | 473 | 532 | 709 | 887 | 946 | 1064 | 1182 | 1242 | 1419 |
| 13 | 164 | 218 | 327 | 437 | 491 | 655 | 819 | 873 | 982 | 1092 | 1146 | 1310 |
| 14 | 152 | 203 | 304 | 405 | 456 | 608 | 760 | 811 | 912 | 1014 | 1064 | 1216 |
| 15 | 142 | 189 | 284 | 378 | 426 | 568 | 709 | 757 | 851 | 946 | 993 | 1135 |
| 16 | 133 | 177 | 266 | 355 | 399 | 532 | 665 | 709 | 798 | 887 | 931 | 1064 |
| 17 | 125 | 167 | 250 | 334 | 376 | 501 | 626 | 668 | 751 | 835 | 876 | 1002 |
| 18 | 118 | 158 | 236 | 315 | 355 | 473 | 591 | 631 | 709 | 788 | 828 | 946 |
| 19 | 112 | 149 | 224 | 299 | 336 | 448 | 560 | 597 | 672 | 747 | 784 | 896 |
| 20 | 106 | 142 | 213 | 284 | 319 | 426 | 532 | 568 | 639 | 709 | 745 | 851 |
| 21 | 101 | 135 | 203 | 270 | 304 | 405 | 507 | 541 | 608 | 676 | 709 | 811 |
| 22 | 97 | 129 | 193 | 258 | 290 | 387 | 484 | 516 | 580 | 645 | 677 | 774 |
| 23 | -- | 123 | 185 | 247 | 278 | 370 | 463 | 494 | 555 | 617 | 648 | 740 |
| 24 | -- | 118 | 177 | 236 | 266 | 355 | 443 | 473 | 532 | 591 | 621 | 709 |
| 25 | -- | 114 | 170 | 227 | 255 | 341 | 426 | 454 | 511 | 568 | 596 | 681 |
| 26 | -- | 109 | 164 | 218 | 246 | 327 | 409 | 437 | 491 | 546 | 573 | 655 |
| 27 | -- | 105 | 158 | 210 | 236 | 315 | 394 | 420 | 473 | 526 | 552 | 631 |
| 28 | -- | 101 | 152 | 203 | 228 | 304 | 380 | 405 | 456 | 507 | 532 | 608 |
| 29 | -- | -- | 147 | 196 | 220 | 294 | 367 | 391 | 440 | 489 | 514 | 587 |
| 30 | -- | -- | 142 | 189 | 213 | 284 | 355 | 378 | 426 | 473 | 497 | 568 |

FIG. 10

METHOD FOR CONTROLLING PERCUSSION DEVICE, SOFTWARE PRODUCTION, AND PERCUSSION DEVICE

CROSS REFERENCE TO RELATED APPLICATIONS

This application is a National Stage of International Application No. PCT/FI2005/050257 filed Jun. 30, 2005, and which claims benefit of Finnish Patent Application No. 20040929 filed Jul. 2, 2004, which is incorporated by reference herein in its entirety.

BACKGROUND OF THE INVENTION

The invention relates to a method for controlling a percussion device, the method comprising: providing impact pulses with the percussion device during drilling to a tool connectable to a rock-drilling machine; and generating a compression stress wave to the tool to propagate at a propagation velocity dependent on the tool material from a first end to a second end of the tool, with at least some of the compression stress reflecting back from the second end of the tool as a reflected wave that propagates toward the first end of the tool; and controlling the percussion device in the rock-drilling machine and its impact frequency.

The invention further relates to a software product for controlling percussion rock-drilling, the execution of which software product in a control unit controlling the rock drilling is arranged to perform at least the following action: to control the percussion device in the rock-drilling machine during drilling to provide impact pulses to a tool connectable to the rock-drilling machine, whereby a compression stress wave is arranged to form in the tool to propagate at a propagation velocity dependent on the tool material from a first end to a second end of the tool, with at least some of the compression stress reflecting back from the second end of the tool as a reflected wave that propagates toward the first end of the tool; and further to control the impact frequency of the percussion device.

The invention further relates to a percussion device that comprises: means for generating a impact pulse to a tool, whereby a compression stress wave caused by the impact pulse is arranged to propagate from a first end to a second end of the tool, and at least some of the compression stress reflects back from the second end of the tool as a reflected wave and propagates toward the first end of the tool; a control unit for controlling the impact frequency of the percussion device; and means for defining at least the impact frequency of the percussion device.

The invention further relates to a percussion device that comprises: means for generating a impact pulse to a tool, whereby a compression stress wave caused by the impact pulse is arranged to propagate from a first end to a second end of the tool, and at least some of the compression stress reflects back from the second end of the tool as a reflected wave and propagates toward the first end of the tool; means for controlling the impact frequency of the percussion device; and means for defining the impact frequency of the percussion device.

Percussive rock drilling uses a rock-drilling machine having at least a percussion device and a tool. The percussion device generates a compression stress wave that propagates through a shank to the tool and on to a drill bit at the outermost end of the tool. The compression stress wave propagates in the tool at a velocity that depends on the material of the tool. It is, thus, a propagating wave, the velocity of which in a tool made of steel, for instance, is 5,190 m/s. When the compression stress wave reaches the drill bit, it makes the drill bit penetrate the rock. However, it has been detected that 20 to 50% of the energy of the compression stress wave generated by the percussion device reflects back from the drill bit as a reflected wave that propagates in the tool into the reverse direction, i.e. toward the percussion device. Depending on the drilling situation, the reflected wave can comprise only a compression stress wave or a tensile stress wave. However, a reflected wave typically comprises both a tensile and a compression stress component. Today, the energy in the reflected waves cannot be efficiently utilized in drilling, which naturally reduces the efficiency of drilling. On the other hand, it is known that reflected waves cause problems to the durability of drilling equipment, for instance.

BRIEF DESCRIPTION OF THE INVENTION

It is an object of the present invention to provide a novel and improved method and software product for controlling a percussion device of a rock-drilling machine, and a percussion device.

The method of the invention is characterized by setting the impact frequency of the percussion device proportional to the propagation time of stress waves that depends on the length of the used tool and the propagation velocity of a wave in the tool material; generating with the percussion device a new compression stress wave to the tool when a reflected wave from one of the previous compression stress waves reaches a first end of the tool; and summing the new compression stress wave and the reflected wave to produce a sum wave that propagates in the tool at the propagation velocity of the wave toward a second end of the tool.

The software product of the invention is characterized in that the execution of the software product is arranged to set the impact frequency of the percussion device proportional to the propagation time of the stress waves.

The percussion device of the invention is characterized in that a control unit is arranged to set the impact frequency proportional to the propagation time of stress waves that depends on the length of the used tool and the propagation velocity of a wave in the tool material.

A second percussion device of the invention is characterized in that the percussion device comprises means for steplessly and separately controlling the impact frequency and impact energy and that the impact frequency of the percussion device is arranged proportional to the propagation time of stress waves that depends on the length of the used tool and the propagation velocity of a wave in the tool material.

The essential idea of the invention is that the impact frequency of the percussion device is arranged in such a manner that every time a new compression stress wave is generated in the tool, a reflected wave from an earlier compression stress wave should be at the percussion device end of the tool. Adjusting the impact frequency must be done proportional to the propagation time of the stress waves. The length of the used tool and the propagation velocity of the stress waves in the tool material affect the propagation time of the stress waves.

The invention provides the advantage that the energy in the reflected wave can now be better utilized in drilling. When the reflected wave has reached the percussion device end of the tool, the tensile stress component in the reflected wave is reflected back toward the drill bit as a compression stress wave. A new primary compression stress wave generated with the percussion device is summed to this reflected compression stress wave, whereby the sum wave formed by the reflected and primary compression stress waves has a higher energy content than the compression stress wave generated with the percussion device only. In addition, the solution of the invention ensures that there is always a good contact between the drill bit and rock. This is due to the fact that there are only compression stress waves propagating toward the drill bit of the tool. When, at the first end of the tool, a new compression stress wave generated by the percussion device is summed to the reflected stress wave, the sum wave is always a compressive stress wave. Therefore, no tensile stress waves propagate toward the drill bit of the tool, which may weaken the contact between the drill bit and rock. Further, when applying the solution of the invention, the feed force may be lower than before, because a good contact between the drill bit and rock is maintained without having to compensate for the effect of tensile stress waves with a high feed force.

An essential idea of an embodiment of the invention is that the shape of the sum wave propagating in the tool from the percussion device toward the drill bit is made as desired by fine-adjusting the impact frequency. The fine-adjustment affects the summing of the compression stress wave reflected from the first end of the tool and the primary compression stress wave generated with the percussion device and, thus, also the shape of the sum wave. By setting the impact frequency higher than the setting defined on the basis of the length of the drilling equipment, a progressive sum wave is obtained. By making the impact frequency lower, it is, in turn, possible to lengthen the sum wave, which in practice lengthens the effective time of compression stress. It is naturally also possible to lengthen the sum wave by increasing the impact frequency sufficiently, whereby the reflected wave attaches to the rear of the generated primary compression stress wave.

An essential idea of an embodiment of the invention is that in extension rod drilling, the impact frequency of the percussion device is set to correspond to the propagation time of a stress wave in one extension rod. The reflected waves propagating from one end of the tool toward the percussion device then propagate to the connection joints between the extension rods substantially simultaneously with the primary compression stress waves propagating from the opposite direction. When arriving substantially simultaneously to the connection joint, the compression stress wave and the reflected wave are summed, whereby the tensile stress component in the reflected wave is neutralized and no tensile stress is, thus, directed to the connection. This way, it is possible to improve the durability of the connections between extension rods.

An essential idea of an embodiment of the invention is that a new primary compression stress wave is summed with a multiple of a reflected wave generated by a previous compression stress wave, i.e. reflected wave, which has propagated several times from one end of the tool to the other. This embodiment can be utilized especially when a short tool is used.

An essential idea of an embodiment of the invention is that the percussion device comprises means for storing the energy in the compression stress component in the reflected wave and for utilizing it in forming new impact pulses. In a percussion device that comprises a reciprocating percussion piston, the energy in the reflected compression stress component can be utilized when the percussion piston is moved in the return direction. The reflected compression stress component can provide the initial velocity of the percussion piston return movement. At the end of the return movement, the kinetic energy of the percussion piston can be stored in pressure accumulators and utilized during a new percussion movement. Percussion devices are also known, in which compression stress waves are generated directly from hydraulic pressure energy without a percussion piston. In percussion devices of this type, the impact pulses can be generated by a lower input energy when the impact frequency is set as described in the invention.

An essential idea of an embodiment of the invention is that the percussion device enables stepless and separate adjustment of the impact frequency and impact energy. For instance, in a percussion device that generates compression stress waves directly from hydraulic pressure energy without a percussion piston, it is possible to adjust the impact frequency by adjusting the rotation rate or operating frequency of a control valve. In this type of percussion device, the impact energy can be adjusted by adjusting the magnitude of hydraulic pressure. In an electric percussion device, the impact frequency can be adjusted by adjusting the frequency of alternating current, for instance, and impact energy can be adjusted by altering the used voltage.

An essential idea of an embodiment of the invention is that it uses an impact frequency of at least 100 Hz.

An essential idea of an embodiment of the invention is that it uses an impact frequency of at least 200 Hz. In practical experience, an impact frequency of over 200 Hz has proven advantageous.

BRIEF DESCRIPTION OF THE FIGURES

The invention is described in greater detail in the attached drawings, in which

FIG. 10 is a table with a few impact frequency settings and impact frequency setting multiples for tools of different lengths.

In the figures, the invention is shown simplified for the sake of clarity. Similar parts are marked with the same reference numbers in the figures.

DETAILED DESCRIPTION OF SOME EMBODIMENTS OF THE INVENTION

Figure 1:
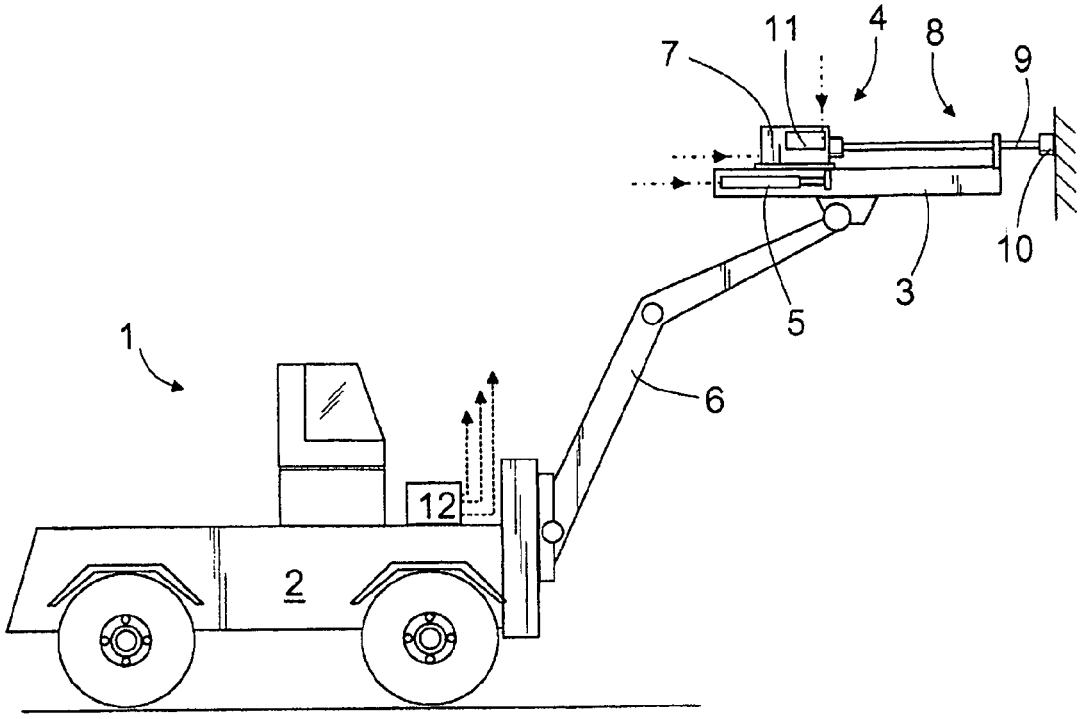
FIG. 1 is a schematic side view of a rock drilling rig.

The rock drilling rig 1 shown in FIG. 1 comprises a carrier 2 and at least one feeding beam 3, on which a movable rock-drilling machine 4 is arranged. With a feeding device 5, the rock-drilling machine 4 can be pushed toward the rock to be drilled and, correspondingly, pulled away from it. The feeding device 5 may have one or more hydraulic cylinders, for instance, that may be arranged to move the rock-drilling machine 4 by means of suitable power transmission elements. The feeding beam 3 is typically arranged to a boom 6 that can be moved with respect to the carrier 2. The rock-drilling machine 4 comprises a percussion device 7 for providing impact pulses to a tool 8 connected to the rock-drilling machine 4. The tool 8 may comprise one or more drill rods and a drill bit 10. The rock-drilling machine 4 may further comprise a rotating device 11 for rotating the tool 8 around its longitudinal axis. During drilling, impact pulses are provided with the percussion device 7 to the tool 8 that can be simultaneously rotated with the rotating device 11. In addition, the rock-drilling machine 4 can during drilling be pushed against the rock so that the drill bit 10 can break the rock. Rock drilling can be controlled by means of one or more control units 12. The control unit 12 may comprise a computer or the like. The control unit 12 may give control commands to actuators controlling the operation of the rock-drilling machine 4 and feeding device 5, such as the valves controlling the pressure medium. The percussion device 7, rotating device 11 and feeding device 5 of the rock-drilling machine 4 can be pressure-medium-operated or electric actuators.

Figure 2A:
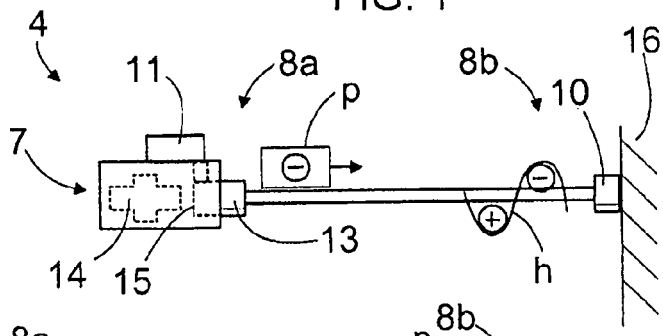
FIG. 2*a* is a schematic side view of a rock-drilling machine and a tool connected thereto in a drilling situation.
Figure 2B:
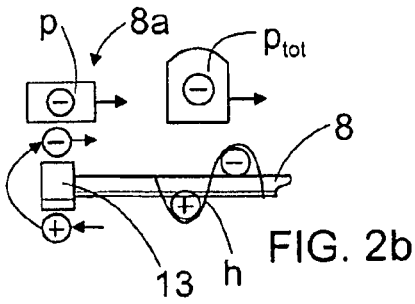
FIG. 2*b* is a schematic view of a first end, i.e. percussion device end, of a tool and the propagation of a reflected stress wave.
Figure 2C:
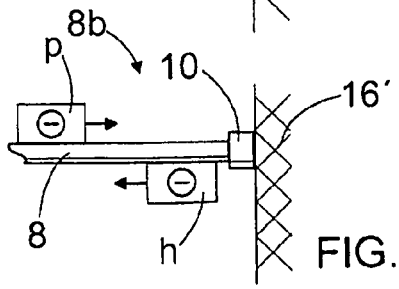
FIGS. 2*c* and 2*d* are schematic views of a special drilling situation and the reflection of a stress wave back from the outermost end, i.e. second end, of a tool.

FIG. 2*a* shows a rock-drilling machine 4 with a tool 8 connected to its drill shank 13. The percussion device 7 of the rock-drilling machine 4 may comprise a percussion element 14, such as a percussion piston arranged movable back and forth, which is arranged to strike a percussion surface 15 on the drill shank 13 and to generate a impact pulse that propagates at a velocity dependent on the material as a compression stress wave through the drill shank 13 and tool 8 to the drill bit 10. One special case of rock drilling is shown in FIG. 2*c*, in which the compression stress wave p cannot make the drill bit 10 penetrate the rock 16. This may be due to a very hard rock material 16', for instance. In such a case, the original stress wave p reflects back as a compression stress wave h from the drill bit 10 toward the percussion device 7. A second special case is shown in FIG. 2*d*. In it, the drill bit 10 can freely move forward without a resisting force. For instance, when drilling into a cavity in the rock, penetration resistance is minimal. The original compression stress wave p then reflects back from the drill bit 10 as a tensile reflection wave toward the percussion device 7. In practical drilling, shown in FIG. 2*a*, the drill bit 10 encounters resistance but is still able to move forward due to the compression stress wave p. A force resists the forward movement of the drill bit 10, and the magnitude of the force depends on how far the drill bit 10 has penetrated the rock 16: the further the drill bit 10 penetrates, the higher the resisting force, and vice versa. Thus, in practice, a reflected wave h comprising both tensile and compression reflection components is reflected from the drill bit 10. In the figures, tensile stress is marked with (+) and compression stress with (−). The tensile reflection component (+) is always first in the reflected wave h and the compression stress component (−) is second. This is due to the fact that at the initial stage of the effect of the primary compression stress wave p, the penetration and penetration resistance of the drill bit 10 is small, whereby the tensile reflection component (+) is formed. The initial situation thus resembles the special situation described above, in which the drill bit 10 can move forward without a significant resisting force. At the final stage of the effect of the primary compression stress wave p, however, the drill bit 10 has already penetrated deeper into the rock 16, in which case the penetration resistance is higher and the original compression stress wave p is no longer able to substantially push the drill bit 10 forward and deeper into the rock 16. This situation resembles the second special case described above, in which the progress of the drill bit 10 into the rock 16 is prevented. This thus generates a reflected compression stress wave (−) that follows immediately after the tensile stress wave (+) reflected first from the drill bit 10.

The propagating stress wave generated with the percussion device 7 to the tool 8 thus propagates from the first end 8*a*, i.e. the percussion device end, of the tool to the second end 8*b*, i.e. drill bit end, of the tool, and again back to the first end 8*a* of the tool. The stress wave then propagates a distance that is twice the length of the tool 8. According to the idea of the invention, the impact frequency of the percussion device 7 is arranged so that the percussion device 7 provides a new impact pulse at substantially the moment when one of the reflected waves of the earlier stress waves reaches the first end 8*a* of the tool 8.

When defining the back-and-forth distance traveled by the stress wave, the length of the drill bit 10 can be ignored, because the axial length of the drill bit 10 is very small in relation to the total length of the tool 8. The drill shank 13 is typically longer, so its length can be taken into account.

Next, the invention will be described using formulas (1), (2) and (3).

The propagation time of the stress wave from the first end of the tool to the second end and back can be calculated with the following formula:

$$t_k = \frac{2(L_{Shank} + nL_{Rod})}{c} = \frac{2L_{tot}}{c} \tag{1}$$

In this formula, $L_{Shank}$ is the length of the drill shank, and $L_{Rod}$ is the length of one drill rod. The total length of the tool is $L_{tot}$, when n is the number of drill rods. C is the propagation velocity of the stress wave in the tool. The propagation time $t_k$ of the stress wave thus depends on the total length $L_{tot}$ of the tool and the propagation velocity c of the stress wave in the material of the tool.

Further, it is possible to calculate the frequency on the basis of the propagation time $t_k$ of the stress wave by using the following formula:

$$f_k = \frac{c}{2(L_{Shank} + nL_{Rod})} \tag{2}$$

It should be noted that the frequency $f_k$ is not the axial natural frequency of the drill rod, but the frequency $f_k$ depends only on the total length of the tool and the propagation velocity of the stress wave.

According to the idea of the invention, the impact frequency $f_D$ of the percussion device can be set proportional to the propagation time of the stress wave. The impact frequency then complies with the following formula:

$$f_D = m\frac{c}{2(L_{Shank} + nL_{Rod})}, \text{ e.g.} \quad m = \ldots, 1/4, 1/3, 1/2, 1, 2, 3, 4, \ldots \tag{3}$$

In formula (3), m is a frequency coefficient that is a quotient or multiple of two integers.

When the frequency coefficient m is a quotient of two integers, it should be noted that the numerator may also be other than 1. The value of the denominator indicates how many times the stress wave propagates back and forth in the tool until a new primary compression stress wave is summed to it. In practice, the maximum value of the denominator is 4.

Thus, in practice, formula (3) means that, in the drilling, an impact frequency is used that is proportional to the propagation time of the stress wave in the tool. This way, a new compression stress wave can be generated to the tool so that it sums with the tensile stress component of the reflected wave. As shown in FIG. 2*b*, when the reflected stress wave h reaches the first end 8*a* of the tool, the tensile stress component (+) cannot be transmitted to the percussion device, because the first end 8*a* of the tool is free. Therefore, the tensile stress component (+) reflects back from the first end 8*a* of the tool as a compression stress component (−) toward the drill bit 10. By means of the percussion device, a new compression stress wave p is summed to the compression stress component reflected from the first end 8*a* of the tool. The generated sum wave $p_{tot}$ of the compression stresses has a higher energy content than a mere compression stress wave p. Further, the energy content of the reflected compression stress component is so low that it alone cannot break rock. All in all, it is a question of the correct timing of the impact pulses generated with the percussion device 7 in relation to the reflected tensile stress components (+).

Figure 2E:
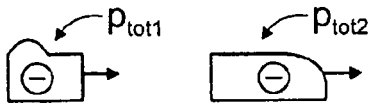
FIG. 2*e* is a schematic view of a few sum wave shapes, the generation of which has been influenced by fine-adjusting the impact frequency.
Figure 2D:
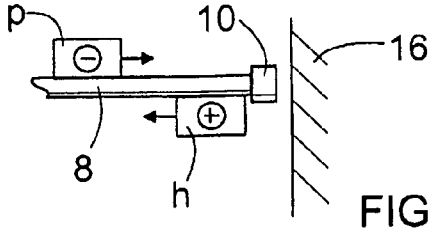

FIG. 2*e* shows a few examples of the shapes of the sum wave $p_{tot}$. By advancing or delaying the generation of the new compression stress wave in relation to the arrival of the tensile reflection component, it is possible to affect the shape of the sum wave $p_{tot}$. In practice, the shape of the sum wave $p_{tot}$ is affected by fine-adjusting the impact frequency. If the impact frequency is set higher than the setting defined on the basis of the drilling equipment, the leftmost sum wave $p_{tot1}$ of FIG. 2*e* is obtained, which is progressive in shape. If the impact frequency is set to be lower than the defined setting, the longer sum wave $p_{tot2}$ is obtained, shown on the right in FIG. 2*e*. In the latter case, the compression stress wave generated with the percussion device attaches to the rear of the reflected compression stress component. FIG. 2*b* also shows the shape of the sum wave $p_{tot}$ corresponding to the setting.

FIGS. 3 to 6 show the principle of extension rod drilling. In such a case, the tool 8 comprises two or more extension rods 17*a* to 17*c* that are joined together with couplings 18*a*, 18*b*. The coupling 18 generally has connection threads to which the extension rods 17 are connected. The coupling 18 can be part of the extension rod 17. The connected extension rods 17 are typically substantially equal in length. One problem with extension rod drilling is that the tensile stress component (+) reflected from the second end 8*b* of the tool 8 may damage the coupling 18 and especially the connection threads thereof. By means of the invention, the impact frequency of the percussion device 7 can be set so that the primary compression stress wave p is always at the coupling 18 substantially simultaneously with the reflected tensile stress component (+). The effects of the primary compression stress wave p and the tensile stress component (+) are then summed at the coupling 18, which ensures that no tensile stress is directed to the coupling 18. Thus, the durability of the couplings 18 and extension rods 17 can be better than before. Because the primary compression stress wave p may be rather long, the compression stress wave p and the reflected wave h do not need to be at the coupling 18 at exactly the same time, but it is enough that the compression stress wave p still affects the connection point when the tensile stress component (+) of the reflected wave h reaches it.

In extension rod drilling, the impact frequency of the percussion device 7 can be set proportional to the propagation time of the stress wave by using the following formula:

$$f_D = \frac{c}{2L_{Rod}} \tag{4}$$

The impact frequency is thus set to correspond to the length $L_{Rod}$ of one extension rod 17. Further, the length of the drill shank 13 can be ignored, because the length of the drill shank 13 is small in relation to the length of the extension rod 17.

Figure 3:
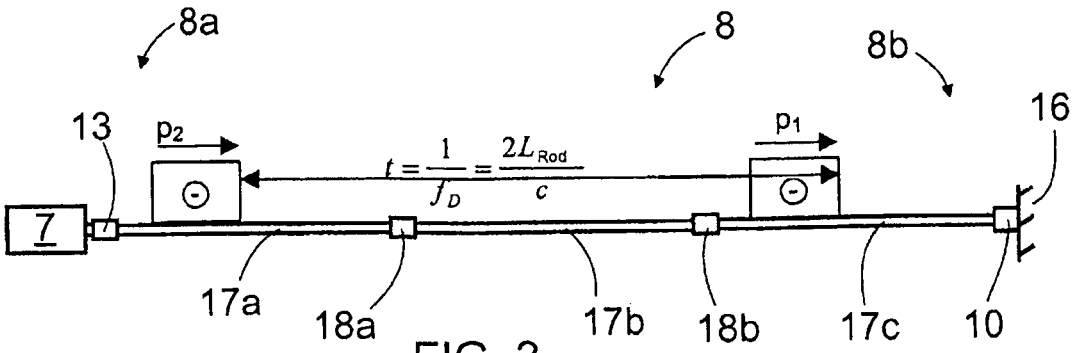
FIGS. 3 to 6 are schematic views at different times of the propagation of primary compression stress waves and waves reflected from the outermost end of the tool in a tool comprising several extension rods.
Figure 4:
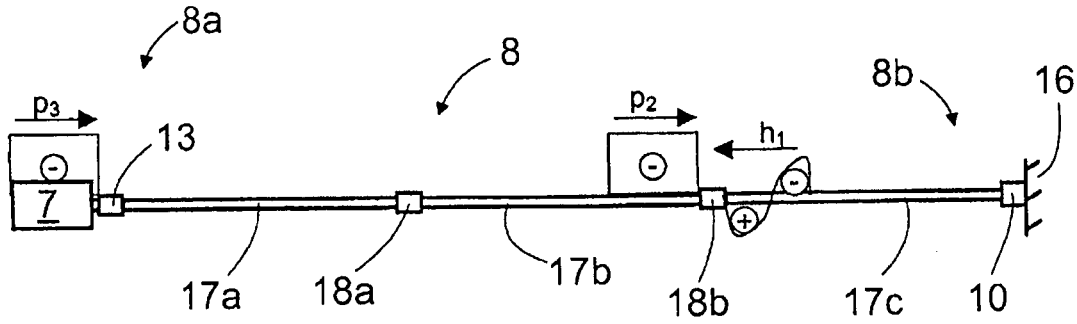
Figure 5:
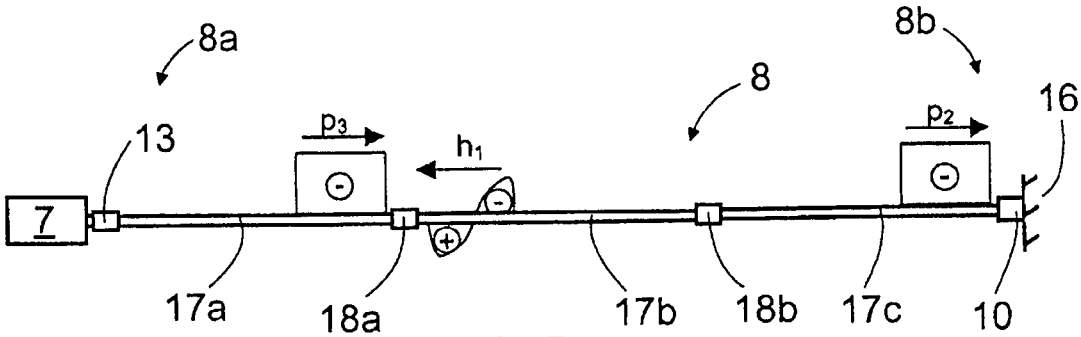
Figure 6:
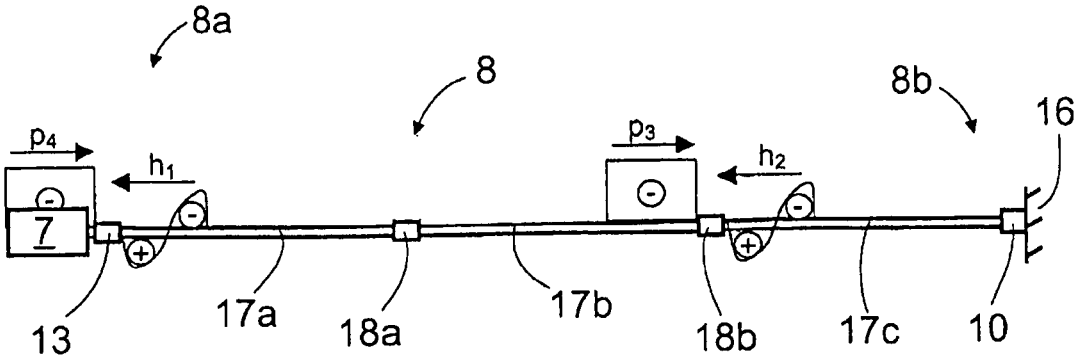

Next, the propagation of stress waves in extension rod drilling is described in more detail and with reference to FIGS. 3 to 6. In FIG. 3, drilling has just been started and the first compression stress wave p1 generated with the percussion device 7 has already reached the third extension rod 17*c*. The second stress wave p2, third stress wave p3, and the stress waves after that are generated according to formula (4), i.e. the impact frequency of the percussion device 7 is arranged proportional to the propagation time of the stress wave. The first reflected wave h1 reflected from the second end 8*b* of the tool 8 then propagates to the second coupling 18*b* substantially simultaneously with the second compression stress wave p2. This is illustrated in FIG. 4. Further, in the situation of FIG. 5, the first reflected wave h1 has already reached the first coupling 18*a*, as has the third compression stress wave p3 propagating from the opposite direction. In FIG. 6, the second reflected wave h2 has propagated to the second coupling 18*b* substantially simultaneously with the third compression stress wave p3. Every time a reflected wave h comprising a tensile stress component (+) has propagated to a connection, a compression stress wave p propagating from the opposite direction also affects the connection point, as a result of which the compression stress wave p cancels the tensile stress component (+).

Figure 7:
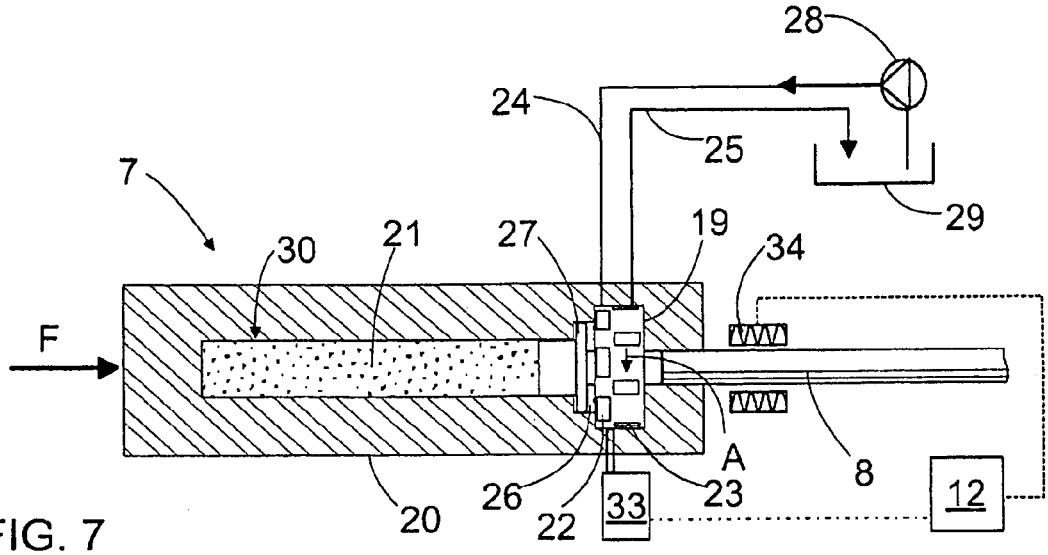
FIG. 7 is a schematic cross-sectional view of a percussion device of the invention and its operational control.
Figure 8:
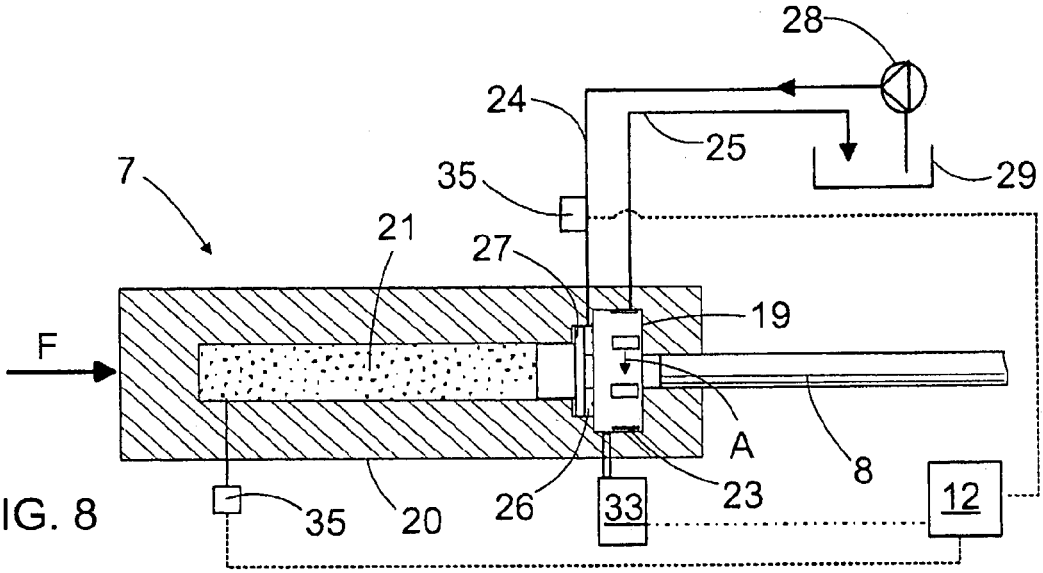
FIG. 8 is a schematic cross-sectional view of a second percussion device of the invention and its operational control.
Figure 9:
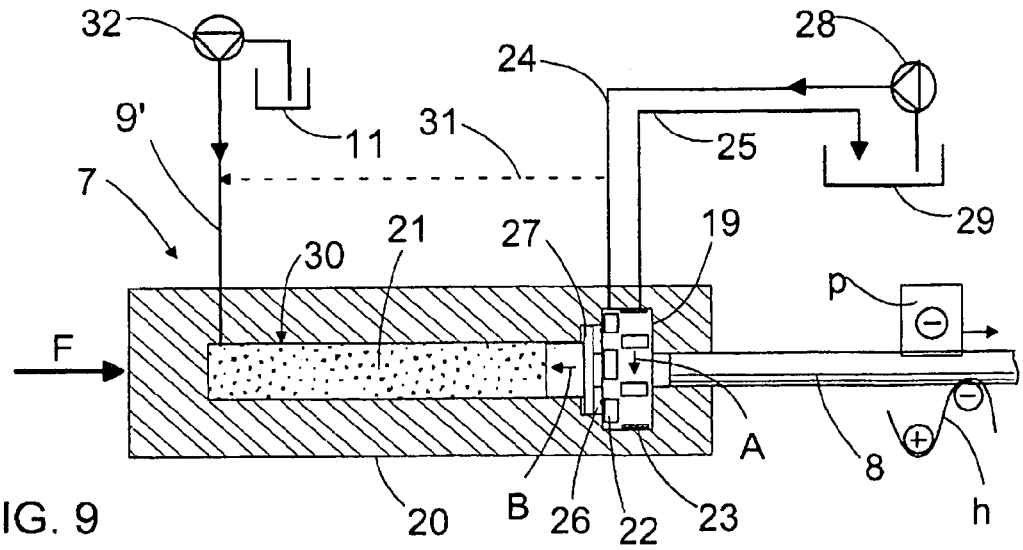
FIG. 9 is a schematic cross-sectional view of a third percussion device of the invention and its operational control.

FIGS. 7 to 9 show a few percussion devices 7, in which the impact frequency can be affected by adjusting the rotation or turning of a control valve 19 around its axis. With the percussion devices of FIGS. 7 to 9, it is possible to achieve a very high impact frequency. The impact frequency can be over 450 Hz, even over 1 kHz.

The percussion device 7 of FIG. 7 has a frame 20 with a stress element 21 inside it. The percussion device further has a control valve 19 that is rotated around its axis with a suitable rotating mechanism or turned back and forth relative to its axis. The control valve 19 may have alternate openings 22 and 23 that open and close connections to a supply channel 24 and correspondingly discharge channel 25. The frame 20 of the percussion device may further have a first pressure-fluid space 26. The percussion device may also have a transmission element, such as a transmission piston 27. The basic principle of this percussion device 7 is that the strain and release of the stress element 21 is controlled using the control valve 19 so that impact pulses are generated. To strain the stress element 21, a pressure fluid supply channel 24 may be led from a pump 28 to the openings 22 in the valve 19. When the control valve 19 rotates, the openings 22 arrive one at a time at the supply channel 24 of pressure fluid and allow pressure fluid to flow through to the pressure fluid space 26. As a result of this, a transmission piston 27 can push against the stress element 21, whereby the stress element 21 compresses. As a result of the compression, energy is stored in the transmission piston 27, which endeavours to push the transmission piston 27 toward the tool 8. When the control valve 19 turns in the direction indicated by arrow A, a connection is opened from the pressure fluid space 26 through the openings 23 to the discharge channel 25, whereby the pressure fluid in the pressure fluid space 26 can flow quickly into a pressure tank 29. When pressure fluid exits from the pressure fluid space 26, the stress element 21 is released and the force generated by the stress compresses the tool 8. The energy stored in the stress element 21 transmits as a stress pulse into the tool 8. The stress element 21 and transmission piston 27 may be separate pieces, in which case the stress element 21 may be made of a solid material or it may be formed by pressure fluid in a second pressure-fluid space 30. If the stress element 21 is made of a solid material, it may be integrated to the transmission piston 27.

FIG. 8 shows one embodiment of the percussion device 7 of FIG. 7, in which pressure fluid is fed directly, without the control of the control valve 19, from the pump 28 along the supply channel 24 to the first pressure-fluid space 26. In such a case, it is enough that the control valve 19 has openings 23 for allowing the pressure fluid from the pressure fluid space 26 to the discharge channel 25. Thus, this solution only controls the pressure release of the pressure fluid from the first pressure-fluid space 26 at a suitable frequency to generate stress pulses to the tool 8.

FIG. 9 shows a percussion device that has a second pressure-fluid space 30 that may be connected through a channel 31 to a pressure source 32 so that pressure fluid can be fed to the pressure fluid space 30. In this solution, the pressure fluid in the second pressure-fluid space 30 may serve as the stress element 21. The transmission piston 27 or the like may separate the first pressure-fluid space 26 and the second pressure-fluid space 30 from each other. The pump 28 can feed pressure fluid through the control valve 19 to the first pressure-fluid space 26. The control valve 19 may be arranged to open and close the connection from the first pressure-fluid space 26 to the supply channel 24 and, on the other hand, to the discharge channel 25. The pumps 28 and 32 may also be connected to each other. When pressure fluid is, controlled by the control valve 19, fed to the first pressure-fluid space 26, the transmission piston 27 moves in the direction indicated by arrow B to its backmost position, whereby pressure fluid exits from the second pressure-fluid space 30. After this, the control valve 19 turns relative to its axis into a position, in which pressure fluid can flow fast from the first pressure-fluid space 26 to the discharge channel 25. The pressure acting in the second pressure-fluid space 30 and the pressure generated by the pump 32 then act on the transmission piston 27 and generate a force, as a result of which the transmission piston 27 pushes toward the tool 8. The transmission piston 27 compresses the tool 8, as a result of which an impact pulse is generated to the tool 8 to propagate as a compression stress wave p through the tool 8. A reflected pulse h from the rock being drilled propagates through the tool 8 back toward the percussion device 7. This reflected pulse endeavours to push the transmission piston 27 in the direction indicated by arrow B, whereby energy of the reflected pulse is transmitted to the pressure fluid in the second pressure-fluid space 30. The amount of the pressure fluid fed into the second pressure-fluid space 30 can then be small, in which case the impact pulse can be generated using a small amount of in-fed energy.

In the solutions of FIGS. 7 to 9, the control valve 19 can be rotated or turned around its axis by means of a rotating motor 33, for instance, which may be pressure medium-operated or an electric device, and it may be connected to act on the control valve 19 through suitable transmission elements, such as gearwheels. Differing from the solutions shown in FIGS. 7 to 9, the rotating motor 33 may be integrated to the control valve 19. The movement of the control valve 19 can be relatively exactly controlled by means of the rotating motor 33, whereby the adjustment of the impact frequency of the percussion device 7 is also exact. Thus, impact pulses can be generated according to the invention by using exactly the correct impact frequency that depends on the length of the used drilling equipment. An exact adjustment of the impact frequency also makes it possible to fine-adjust the impact frequency and to affect the shape of the sum wave. In addition, the adjustment of the impact frequency and the impact energy may be stepless. The adjustment of the impact frequency and the impact energy may be done separately. This means that the impact frequency and the size of impact energy may both separately be set to a desired value.

The impact frequency used in drilling can be measured in many different ways. FIG. 7 shows one possibility, i.e. the stress wave propagating in the tool 8 or drill shank 13 can be detected by means of a suitable coil 34. FIGS. 8 and 9, in turn, describe measuring by means of suitable sensors 35 the pressure or pressure flow of at least one pressure fluid channel or pressure fluid space of the percussion device and transmitting the measuring information to the control unit 12 of the percussion device, which has means for processing measuring results. On the basis of the pulse in the measuring results, the control unit 12 can analyze the impact frequency of the percussion device 7. It is also possible to measure the turning or rotating movement of the control valve 19 shown in FIGS. 7 to 9 and to determine the used impact frequency based thereon. In addition to the above-mentioned solutions, it is also possible to determine the impact frequency by measuring other physical phenomena, which indicate the formation of impact pulses, from the percussion device or the means belonging thereto. Thus, it is also possible to utilize for instance piezoelectric sensors, acceleration sensors and sound detectors in measuring the impact frequency.

It is also possible to determine the propagation time of the stress waves in manners other than the mathematical way described above by means of the length of the tool 8 and the propagation velocity of the stress wave. The percussion device 7 may comprise one or more sensors or measuring instruments for measuring the reflected wave h returning from the second end 8*b* of the tool. On the basis of the measuring results, the control unit 12 may determine the propagation time of the waves in the tool and adjust the impact frequency.

A control strategy of the invention may further be set in the control unit 12 of the percussion device to take into account the measured impact frequency and the used drilling equipment and to automatically adjust the impact frequency according to the idea of the invention. The adjustment of the impact frequency may also be done manually, whereby the control unit 12 of the percussion device informs the used impact frequency to the operator and the operator manually adjusts the impact frequency so that it, in the manner of the invention, depends on the used drilling equipment. The operator may have tables or other auxiliary means that indicate the impact frequency to be used in drilling with tools of different lengths. Otherwise, the information on exact impact frequencies can be stored in the control unit 12, from which the operator can fetch them. The control unit 12 can also guide the operator in adjusting the correct impact frequency. It is further possible that a manipulator of an extension rods is arranged to detect an identifier in the extension rod and to indicate to the control unit the total length of the tool used at each time and the length of each extension rod.

It should be noted that, for the sake of clarity, FIG. 9 does not show the means for rotating or turning the control valve 19, the control unit, or the means for measuring the impact frequency.

The invention can be applied to both a pressure fluid-operated and electrically operated percussion device. It is not essential for the implementation of the invention, what type of percussion device generates the compression stress waves propagating in the tool. The impact pulse is a short-term force effect provided by a percussion device to generate a compression stress wave to a tool.

The method of the invention can be performed by running a computer program in one or more computer processors belonging to the control unit 12. A software product that executes the method of the invention can be stored in a memory of the control unit 12, or the software product can be loaded to the computer from a memory means, such as CD-ROM disk. Further, the software product can be loaded from another computer through an information network, for instance, to a device belonging to the control system of a mining vehicle.

The table of FIG. 10 shows some impact frequency settings for a few tool lengths and some typical multiples thereof. As an example, it can be mentioned that if the impact frequency range of a percussion device is 350 to 650 Hz, it is possible to select from the table suitable frequencies that are shown framed in table 10. The value of the denominator of the frequency coefficient indicates how many times a stress wave propagates back and forth in a tool until a new primary compression stress wave is summed to it. The smaller the denominator value, the less the reflected stress wave loads the tool. Therefore, in selecting the frequency coefficient, one should prefer values, in which the denominator of a quotient has as small a value as possible.

It should be noted that when using the invention, it is possible to utilize various combinations and variations of the features described in this application.

The percussion device of the invention can be used not only in drilling, but also in other devices utilizing impact pulses, such as breaking hammers and other breaking devices for rock material or other hard material, and pile-driving devices, for instance.

The drawings and the related description are only intended to illustrate the idea of the invention. The invention may vary in detail within the scope of the claims.

The invention claimed is:

1. A method for controlling a percussion device, the method comprising:

providing impact pulses with the percussion device during drilling to a tool connectable to a rock-drilling machine; and generating a compression stress wave to the tool to propagate at a wave propagation velocity dependent on the tool material from a first end to a second end of the tool, with at least some of the compression stress reflecting back from the second end of the tool as a reflected wave that propagates toward the first end of the tool; and controlling the percussion device in the rock-drilling machine and its impact frequency, selling the impact frequency of the percussion device proportional to the propagation time of the stress waves that depends on the length of the used tool and the propagation velocity of the wave in the tool material;

generating with the percussion device a new compression stress wave to the tool when the reflected wave from one of the previous compression stress waves reaches the first end of the tool; and summing the new compression stress wave and the reflected wave to produce a sum wave that propagates in the tool at the propagation velocity of the wave toward the second end of the tool.

2. A method as claimed in claim 1, comprising:

adjusting the shape of the sum wave by the fine-adjusting the impact frequency; and in the fine-adjustment, advancing or delaying the generation of the new impact pulses from the setting of the impact frequency, which is defined proportional to the propagation time of the stress waves, whereby the fine-adjustment affects the summing of the new compression stress wave and reflected wave and, thus, also the shape of the sum wave.

3. A method as claimed in claim 1, comprising;

using in drilling a tool that comprises at least two extension rods that are connected to each other with a coupling, setting the impact frequency of the percussion device to correspond to the propagation time of a stress wave from one end of an extension rod to the other and back, timing by means of the impact frequency a compression stress wave propagating toward the second end of the tool and a reflected wave propagating in the opposite direction to reach the connection point of the extension rods substantially simultaneously, and summing at the connection point the compression stress wave and reflected wave, whereby the tensile stress component in the reflected wave is cancelled by the compression stress wave.

4. A method as claimed in claim 1, comprising:

using an impact frequency that is at least 100 Hz.

5. A percussion device comprising:

means for generating a impact pulse to a tool, whereby a compression stress wave caused by the impact pulse is arranged to propagate from a first end to a second end of the tool, and at least some of the compression stress wave reflects back from the second end of the tool as a reflected wave and propagates toward the first end of the tool;

a control unit for controlling the impact frequency of the percussion device, means for defining at least the impact frequency of the percussion device, and wherein the control unit is arranged to set the impact frequency proportional to the propagation time of the stress waves that depends on the length of the used tool and the propagation velocity of the wave in the tool material.

6. A percussion device as claimed in claim 5, wherein the control unit is arranged to mathematically determine the propagation time of the stress waves in the tool after the control unit has been given length and material information on the tool.

7. A percussion device as claimed in claim 5, wherein connected to the percussion device, there is a tool having at least two extension rods that are connected to each other with a coupling, and the control unit is arranged to set the impact frequency of the percussion device to correspond to the propagation time of a stress wave from one end of an extension rod to the other, whereby a compression stress wave propagating toward the second end of the tool and a reflected wave propagating in the opposite direction are arranged to act substantially simultaneously at the connection point of the extension rods.

8. A percussion device as claimed in claim 5, wherein the percussion device has means for utilizing the energy in the compression stress component of the reflected wave in generating new impact pulses.

9. A percussion device as claimed in claim 5, wherein the control unit is arranged to fine-adjust the impact frequency to affect the shape of the stress wave propagating toward the second end of the tool, and in said fine-adjustment, the control unit is arranged to either advance or delay the impact frequency from the setting defined proportional to the propagation time of the stress waves.

10. A percussion device as claimed in claim 5, wherein the impact pulses are arranged to be generated in the percussion device directly from hydraulic pressure energy without a percussion piston.

11. A percussion device comprising:

means for generating an impact pulse to a tool, whereby a compressions stress wave caused by the impact pulse is arranged to propagate from a first end to a second end of the tool, and at least some of the stress wave reflects back from the second end of the tool as a reflected wave and propagates toward the first end of the tool;

means for controlling the impact frequency of the percussion device, means for defining the impact frequency of the percussion device, means for steplessly and separately controlling the impact frequency and impact energy, and wherein the impact frequency of the percussion device is arranged proportional to the propagation time of the stress waves that depends on the length of the used tool and the propagation velocity of the wave in the tool material.

12. A percussion device as claimed in claim 11, wherein the impact pulses are arranged to be generated in the percussion device directly from hydraulic pressure energy without a percussion piston.

* * * * *